US009255365B1

(12) United States Patent
Schmidt

(10) Patent No.: US 9,255,365 B1
(45) Date of Patent: Feb. 9, 2016

(54) COMPACTION SYSTEM

(71) Applicant: Caterpillar Paving Products Inc., Minneapolis, MN (US)

(72) Inventor: Keith R. Schmidt, Laura, IL (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 14/339,908

(22) Filed: Jul. 24, 2014

(51) Int. Cl.
*E01C 19/26* (2006.01)
*E01C 19/27* (2006.01)
*E01C 19/28* (2006.01)

(52) U.S. Cl.
CPC ..... *E01C 19/266* (2013.01); *E01C 19/27* (2013.01); *E01C 19/286* (2013.01)

(58) Field of Classification Search
CPC ..... E01C 19/286; E01C 19/236; E01C 19/23; E01C 19/27
See application file for complete search history.

(56) References Cited

U.S. PATENT DOCUMENTS 2,537,802 A * 1/1951 Yeppie ..... 172/548
2,538,167 A * 1/1951 Schmeiser ..... 172/545
3,192,838 A * 7/1965 Cook ..... 404/132
3,245,286 A * 4/1966 Hewko ..... 475/114
3,338,315 A * 8/1967 Ketel ..... 172/537
3,603,226 A * 9/1971 Marcovitch ..... 404/132
3,783,701 A * 1/1974 Steprath et al. ..... 74/87
4,339,004 A 7/1982 van der Lely et al.
4,459,875 A * 7/1984 Mann et al. ..... 475/83
6,350,082 B1 2/2002 Rickards
7,563,053 B2 7/2009 Tyhy et al.
2003/0230417 A1* 12/2003 Maas ..... 172/22
2004/0168531 A1* 9/2004 Mitsui ..... 74/86
2006/0131039 A1* 6/2006 Maas et al. ..... 172/22
2012/0301221 A1* 11/2012 Ackermann et al. ..... 404/75
2013/0090815 A1* 4/2013 Muller ..... 701/48
2013/0202366 A1* 8/2013 Maas ..... 405/271

FOREIGN PATENT DOCUMENTS

GB 868447 5/1961
WO 2011064367 6/2011

* cited by examiner

*Primary Examiner* — Abigail A Risic
(74) *Attorney, Agent, or Firm* — Andrew A. Philips

(57) ABSTRACT

A compaction system for providing one or more compaction passes for each pass of the compaction system is provided. The compaction system includes a belt and a sun element having a first axis and positioned within the belt. The compaction system also includes a planet element engaged with the sun element and the belt. The planet element is configured to revolve around the sun element and the first axis. The belt also revolves around the sun element. Further, for every revolution of the belt around the sun element, the planet element completes one or more revolutions around the sun element.

15 Claims, 6 Drawing Sheets

COMPACTION SYSTEM

TECHNICAL FIELD

The present disclosure relates to a compaction system for a machine, and more specifically to a rotary assembly of the compaction system.

BACKGROUND

Generally, compaction of soil and asphalt surfaces is performed by a compaction machine making one or more passes over the surface. In some situations, a metallic roller may be used to perform the passes of compaction. However, the metallic roller may generate cracks in the asphalt surface due to over compaction and/or a weight of the metallic roller which may eventually lead to failure of the asphalt surface. In some situations, a rubber roller may be used to perform the passes of compaction. The rubber roller may eliminate the generation of cracks in the asphalt surface. However, the rubber roller may require multiple passes, and generally more passes than the metallic roller, in order to yield a required level of compaction of the asphalt surface. Multiple machine passes are time consuming and result in lower productivity of the compaction machine and higher cost to accomplish the required compaction.

U.S. Pat. No. 6,350,082, hereinafter referred to as the '082 patent, discloses a method of compacting a mat of hot mix asphalt laid by an advancing asphalt paver. The method includes advancing an asphalt compactor over the laid asphalt such that a compaction surface of the compactor, formed by a lower run of at least one belt, is engaged with any one portion of the mat. The compaction is achieved using a compactor. The compactor includes two longitudinally spaced modular compaction units connected relative to each other. The modular compaction units include a compaction belt and a plurality of rollers within the compaction belt. The compaction belt and the plurality of rollers are configured to provide one or more runs over the surface for providing compaction thereof.

The '082 patent discloses a system or a method to provide compaction of soil and/or asphalt surfaces using only a limited number of passes in a single pass of the machine. The number of passes provided by the machine in every pass of the machine may be limited by the number of rollers provided within the belt. Additionally, the system disclosed in the '082 patent is overly complex as compared to compaction machines known in the art. Hence, there is a need for an improved compaction system for performing the compaction process.

SUMMARY OF THE DISCLOSURE

In one aspect of the present disclosure, a compaction system for providing one or more compaction passes for each pass of the compaction system is provided. The compaction system includes a belt and a sun element having a first axis and positioned within the belt. The compaction system also includes a planet element engaged with the sun element and the belt. The planet element is configured to revolve around the sun element and the first axis. The belt also revolves around the sun element. Further, for every revolution of the belt around the sun element, the planet element completes one or more revolutions around the sun element.

In another aspect of the present disclosure, a compaction machine is provided. The compaction machine includes a frame and a power source provided on the frame. The compaction machine includes at least one compaction system rotatably coupled to the frame. The at least one compaction system is configured for providing one or more compaction passes for each pass of the at least one compaction system. The at least one compaction system includes a belt and a sun element having a first axis and positioned within the belt. The at least one compaction system also includes a planet element engaged with the sun element and the belt. The planet element is configured to revolve around the sun element and the first axis. The belt also revolves around the sun element. Further, for every revolution of the belt around the sun element, the planet element completes one or more revolutions around the sun element.

In yet another aspect of the present disclosure, a compaction system for providing one or more compaction passes for each pass of the compaction system is provided. The compaction system includes a sun element having a first axis. The compaction system also includes a pneumatic tire engaged with the sun element. The pneumatic tire is configured to revolve around the sun element and the first axis. Further, for every revolution of the compaction system, the pneumatic tire completes one or more revolutions around the sun element.

Other features and aspects of this disclosure will be apparent from the following description and the accompanying drawings.

DETAILED DESCRIPTION

Figure 1:
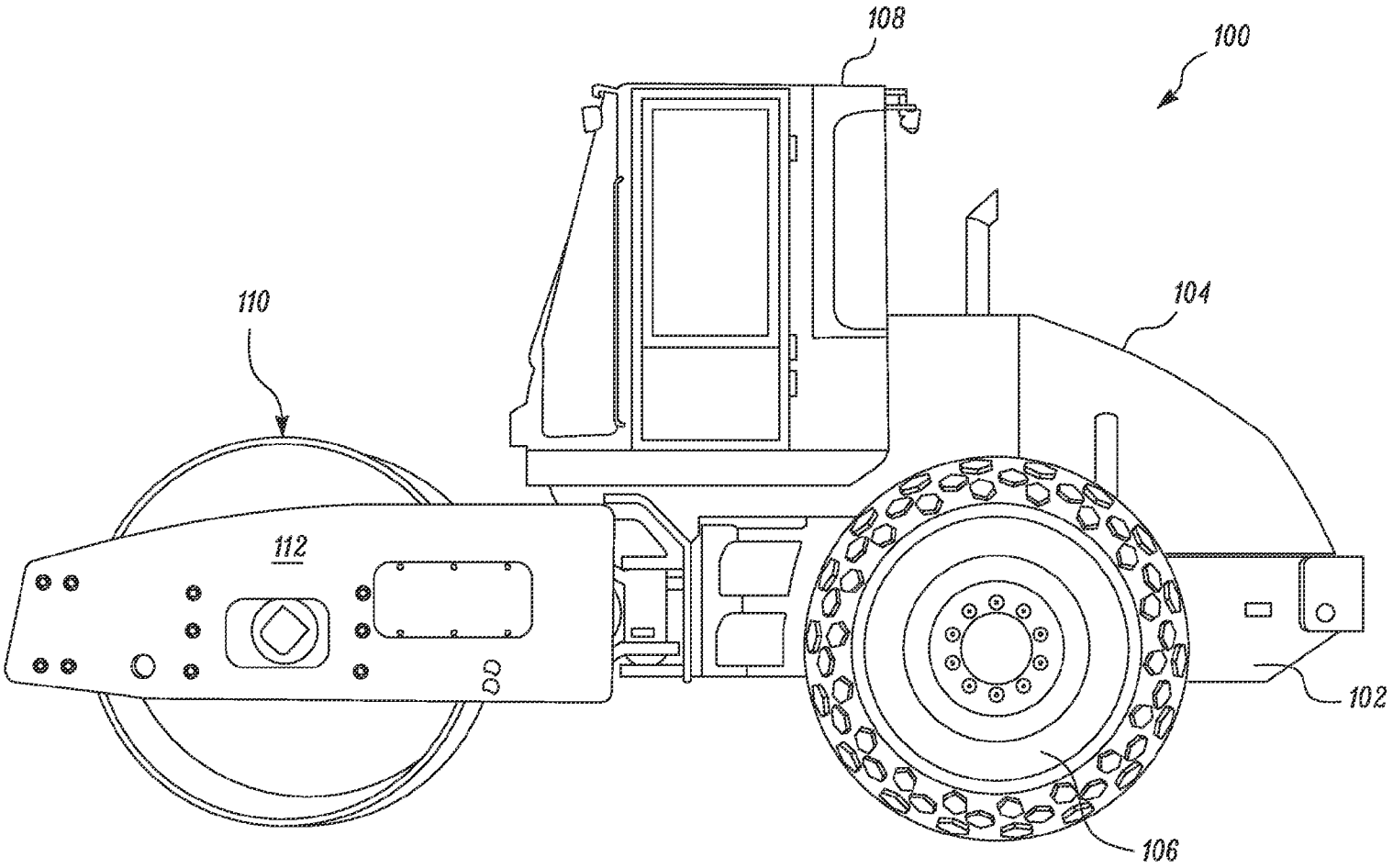
FIG. 1 is an exemplary machine, according to an embodiment of the present disclosure.

Wherever possible, the same reference numbers will be used throughout the drawings to refer to the same or the like parts. Referring to FIG. 1, an exemplary machine 100 is illustrated. More specifically, the machine 100 is a soil compactor. In other embodiments, the machine 100 may be any other machine known in the art, such as, a pneumatic compactor, an asphalt compactor, a utility compactor, a landfill compactor, and so on. The machine 100 is configured to compact a surface by providing one or more passes while compacting the surface.

The machine 100 includes a frame or a chassis 102. The frame 102 is configured to support and/or mount one or more components of the machine 100. The machine 100 includes an enclosure 104 provided on the frame 102. The enclosure 104 is configured to house a power source (not shown). The power source may be any power source known in the art including, but not limited to, an internal combustion engine, an electric motor and so on, or a combination thereof. The power source is configured to provide power to the machine 100 for operational and mobility requirements. The machine 100 includes one or more ground engaging members 106 such as, wheels drivably coupled to the power source. The ground engaging members 106 are configured to provide mobility to the machine 100 on a ground surface.

The machine 100 includes an operator cabin 108 provided on the frame 102. The operator cabin 108 may include one or more control devices (not shown) such as a joystick, a steering wheel, pedals, levers, buttons, switches, and so on. The control device is configured to enable an operator to control the machine 100 on the ground surface as per operational requirements. The operator cabin 108 may also include an operator interface such as, a display device, a sound source, a light source, or a combination thereof. The operator interface may be configured to provide information to the operator related to various machine parameters.

The machine 100 includes a compaction system 110 rotatably coupled to a support structure 112. The support structure 112 extends from the frame 102. In other embodiments, the machine 100 may include more than one compaction systems 110. For example, in one embodiment, another compaction system 110 may be provided by replacing the ground engaging members 106. The compaction system 110 is configured to provide one or more passes of compaction on the ground surface and will be explained later in detail. In some embodiments, the compaction system 110 may include a vibratory apparatus (not shown). The vibratory apparatus may be configured to provide vibration pulses on the ground surface during compaction thereof. In other embodiments, the compaction system 110 may be employed as an attachment to a machine such as a skid steer loader, a wheel loader, a track loader, an integrated tool carrier, an asphalt paver, and so on.

Figure 2:
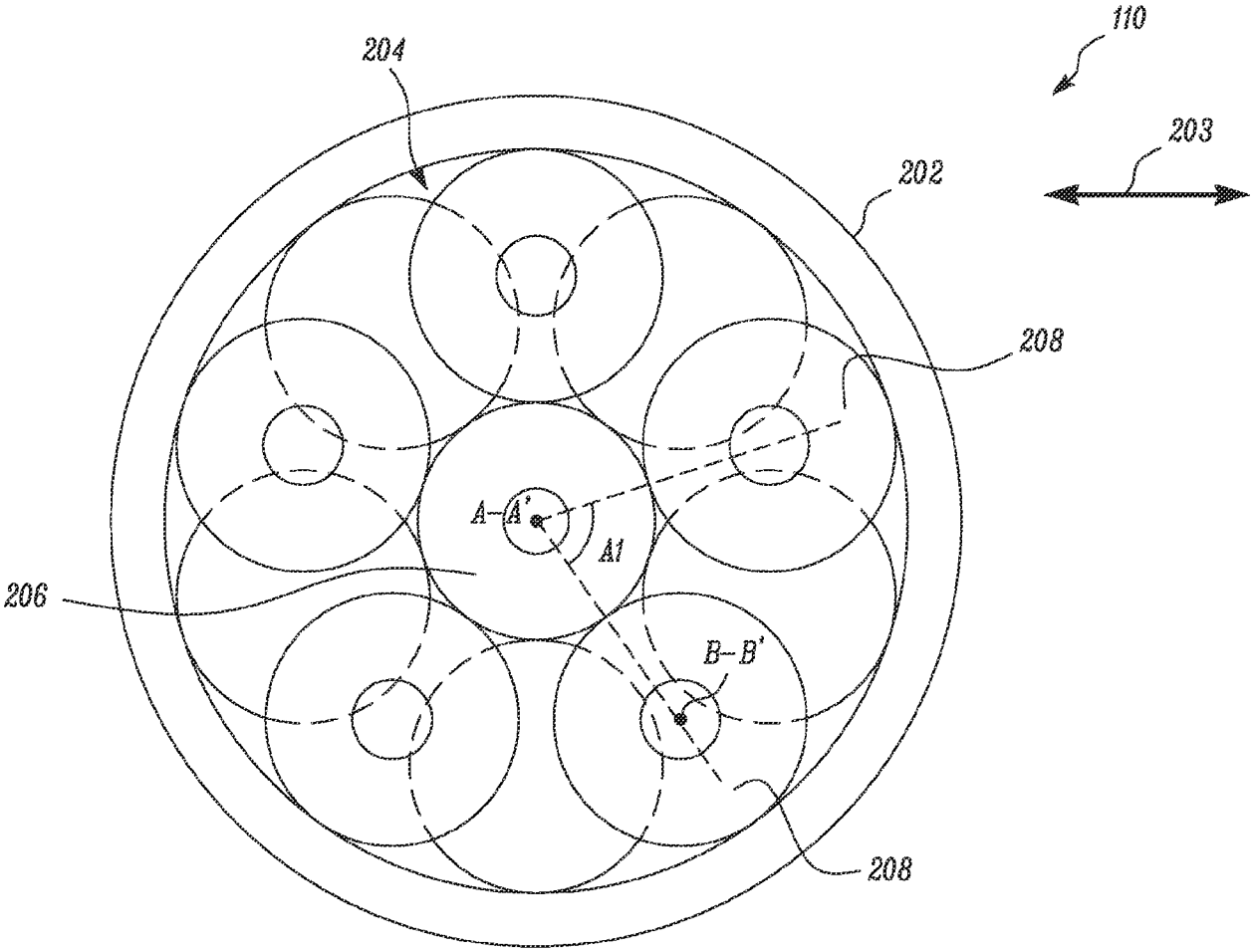
FIG. 2 is a schematic cross sectional view of a rotary assembly of a compaction system, according to an embodiment of the present disclosure.

Referring to FIG. 2, a schematic cross sectional view of the compaction system 110 is illustrated. The compaction system 110 includes a belt 202. The belt 202 may be made of any polymeric material, such as, rubber and so on. The belt 202 is configured to roll on the ground surface in a direction 203 during propulsion of the machine 100 thereon. The belt 202 is also configured to enclose a rotary assembly 204 of the compaction system 110. In some embodiments, the belt 202 may be omitted. Accordingly, the rotary assembly 204 may directly contact the ground surface.

The rotary assembly 204 includes a sun element 206 defining a first axis A-A'. The sun element 206 has an elongated cylindrical configuration. The sun element 206 may be made of any metal or an alloy known in the art.

Additionally, the sun element 206 may include a layer of an elastomeric material provided on an outer surface of the sun element 206. The layer of the elastomeric material is configured to provide a frictional engagement between the sun element 206 and other components of the rotary assembly 204 and will be explained later in detail. In some embodiments, the sun element 206 may be omitted.

The rotary assembly 204 includes a plurality of planet elements 208. In other embodiments, the rotary assembly 204 may include a single planet element 208. In other embodiments, the plurality of planet elements 208 may include two planet elements 208, three planet elements 208, four planet elements 208, and so on based on system design and configuration. Each of the plurality of planet elements 208 is frictionally engaged with the sun element 206 and the belt 202. More specifically, a surface of each of the plurality of planet elements 208 is provided in contact with a surface of the sun element 206 and a surface of the belt 202. As a result, each of the plurality of planet elements 208 may move around the sun element 206 and/or the belt 202 due to friction between the surfaces thereof and complete one or more revolutions around the sun element 206 for every revolution of the belt 202.

In the embodiment, when the belt 202 may be omitted, each of the plurality of planet elements 208 may be frictionally engaged with the sun element 206 only or may be solely supported by the frame 102 and/or the support structure 112. In such a situation, each of the planet elements 208 may directly contact the ground surface during propulsion of the machine 100 thereon. In the embodiment, when the sun element 206 may be omitted, each of the plurality of planet elements 208 may be frictionally engaged with the belt 202 only. Each of the plurality of planet elements 208 is rotatably coupled to a planet axle 402 (shown in FIG. 4) through a planet bearing 406 (shown in FIG. 4). The planet axle 402 is provided along a second axis B-B' such that the second axis B-B' is parallel to the first axis A-A'.

As shown in FIG. 2, each of the plurality of planet elements 208 is angularly offset by an angle "A1" along a circumference of the sun element 206. Each of the plurality of planet elements 208 is configured to revolve around the sun element 206 and the belt 202 about the first axis A-A'. Each of the plurality of planet elements 208 is also configured to rotate about the second axis B-B'. In one embodiment, each of the plurality of planet elements 208 may be a pneumatic tire. In such a situation, the plurality of pneumatic tires may be frictionally engaged with the sun element 206. Each of the plurality of pneumatic tires may be configured to revolve around the sun element 206 about the first axis A-A' and complete one or more revolutions around the sun element 206 for every revolution of the compaction system 110. In other embodiments, each of the plurality of planet elements 208 may include, but not limited to, a hydraulic tire, a cylindrical roller made of any metal, and so on. In yet other embodiments, the plurality of planet elements 208 may be a combination of the pneumatic tires, the hydraulic tires, the cylindrical roller, and so on.

Figure 3:
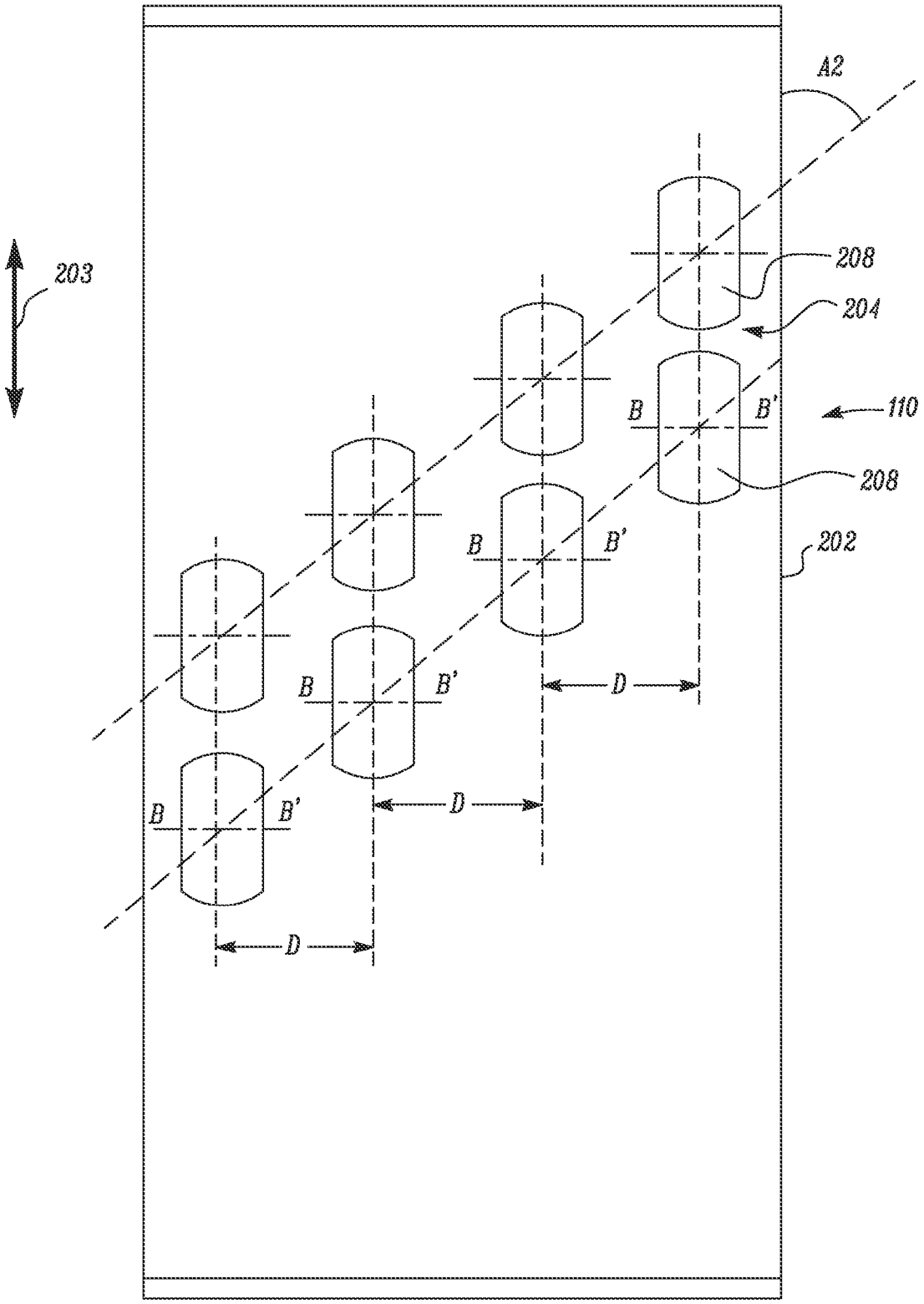
FIG. 3 is a schematic representation of the rotary assembly, according to an embodiment of the present disclosure.

Referring to FIG. 3, a schematic representation of the rotary assembly 204 is illustrated. More specifically, FIG. 3 illustrates an arrangement of the plurality of planet elements 208 with respect to the unrolled belt 202. In addition to the angularly offset arrangement of the planet elements 208 with respect to the sun element 206, each of the plurality of planet elements 208 is also axially offset with respect from one another as defined by a distance "D". Further, each of the plurality of planet elements 208 is also transversely offset by an angle "A2" around the circumference of the sun element 206. The transverse offset is a combination of the angular offset and the axial offset arrangement of each of the planet elements 208.

The angular, axial and transversely offset arrangement of the planet elements 208 forms a staggered pattern of the planet elements 208 around the sun element 206. It should be noted that a number of planet elements 208 and/or number of staggered rows shown in the illustrated figures is merely exemplary and may vary as per system design and configuration. Also, values of the angle "A1", the angle "A2' and/or the distance "D" may vary as per required configuration of the angular, axial and/or transversely offset arrangement. The plurality of planet elements 208 is configured to provide multiple passes of compaction on the ground surface and will be explained in detail later. In the embodiment, when the belt 202 may be omitted, and each of the plurality of planet elements 208 may include the pneumatic tires, each of the plurality of pneumatic tires may directly contact the ground surface and provide one pass of compaction thereon per rotation of the rotary assembly 204.

Figure 4:
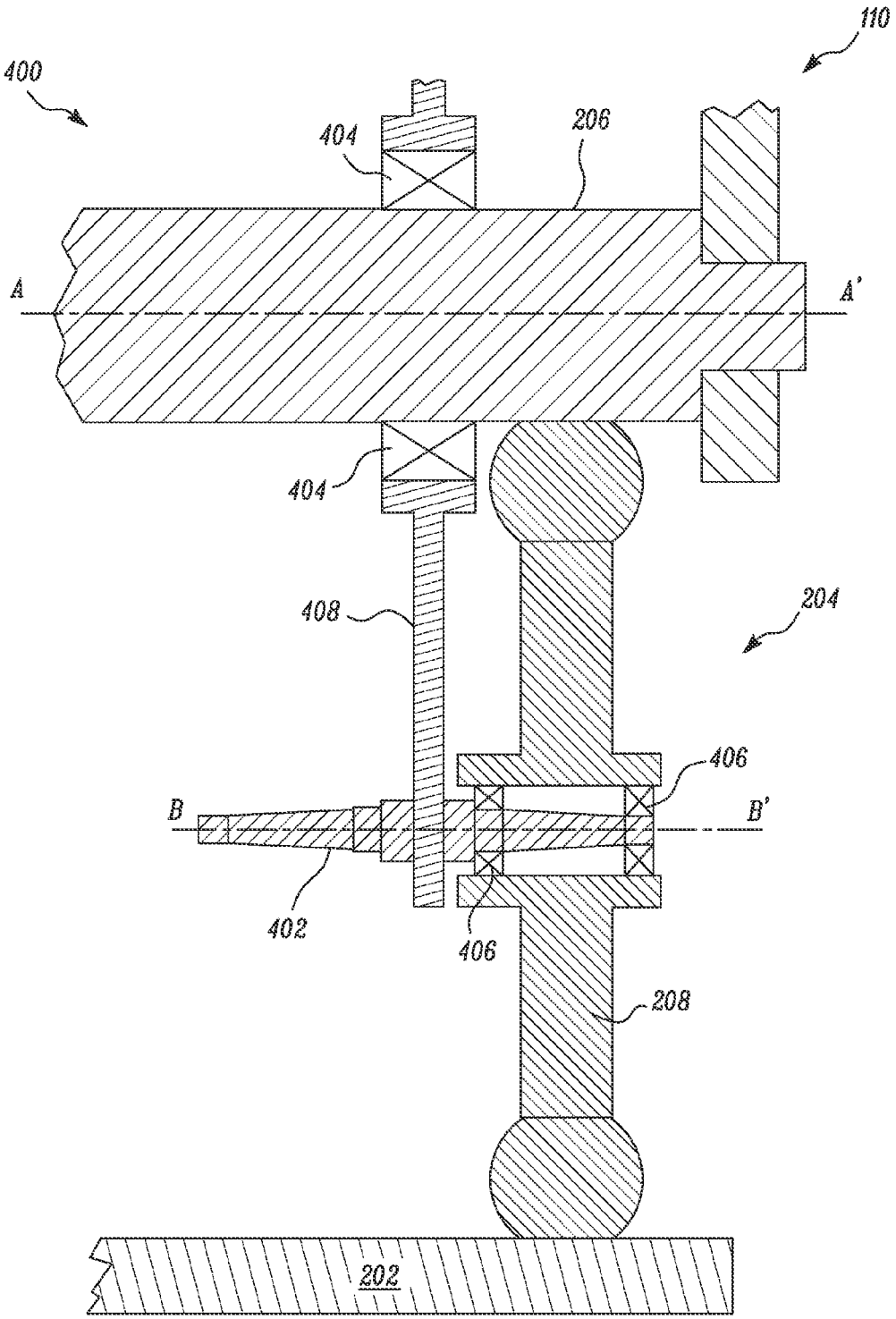
FIGS. 4-6 are schematic representations of different exemplary drive configurations of the rotary assembly, according to an embodiment of the present disclosure.

The rotary assembly 204 includes a planet carrier 408 (shown in FIG. 4). The planet carrier 408 is coupled to the sun element 206 and at least one of the plurality of planet elements 208. The planet carrier 408 is configured to align the at least one of the plurality of planet elements 208 with respect to the sun element 206. The planet carrier 408 is also configured to rotate about the first axis A-A' and/or the sun element 206 based on the revolution of the planet element 208 about the sun element 206. The planet carrier 408 may rotate about the sun element 206 at a speed determined by diameter ratios between the sun element 206, the planet elements 208, the belt 202, a linear speed of the machine 100, and so on, or a combination thereof. In other embodiments, the speed of the planet carrier 408 may also be directly controlled or driven (shown in FIG. 6).

The planet carrier 408 has a circular disc configuration. The planet carrier 408 may be made of any metal or an alloy known in the art. Further, in the embodiment when the planet carrier 408 may be provided between the sun element 206 and each of the plurality of planet elements 208, a tie rod 602 (shown in FIG. 6) may be provided between adjacent planet carriers 408. The tie rod 602 is configured to align the planet carriers 408 with respect to one another and the sun element 206.

The rotary assembly 204 may include at least one of the belt 202, the sun element 206, the at least one planet element 208 and the planet carrier 408 as a driven member based on different drive configurations of the rotary assembly 204. Different drive configurations of the rotary assembly 204 will be explained with reference to FIGS. 4 to 6.

Referring to FIG. 4, an exemplary first drive configuration 400 of the rotary assembly 204 is illustrated. In the first drive configuration 400, the sun element 206 is fixedly coupled to the support structure 112. The planet element 208 is frictionally coupled to the sun element 206 and the belt 202. Also, the planet carrier 408 is provided between the sun element 206 and the planet element 208. More specifically, the planet carrier 408 is rotatably coupled to the sun element 206 through a carrier bearing 404. Also, the planet carrier 408 is fixedly coupled to the planet axle 402 of the planet element 208.

In such a configuration, the machine 100 is propelled on the ground surface by the ground engaging members 106 (shown in FIG. 1). The belt 202 rotates relative to the frame 102 due to a frictional engagement between the belt 202 and the ground surface. Accordingly, the planet element 208 revolves around the sun element 206 and rotates about the planet axle 402 due to the frictional engagement between the planet element 208 and the belt 202. Further, as the planet element 208 revolves about the sun element 206, the planet carrier 408 also rotates about the sun element 206. The revolution and rotation of the planet element 208 results in multiple passes of compaction on the ground surface through the belt 202 per revolution of the belt 202 on the ground surface. In other words, the planet element 208 makes multiple revolutions for every single revolution of the belt 202.

Figure 5:
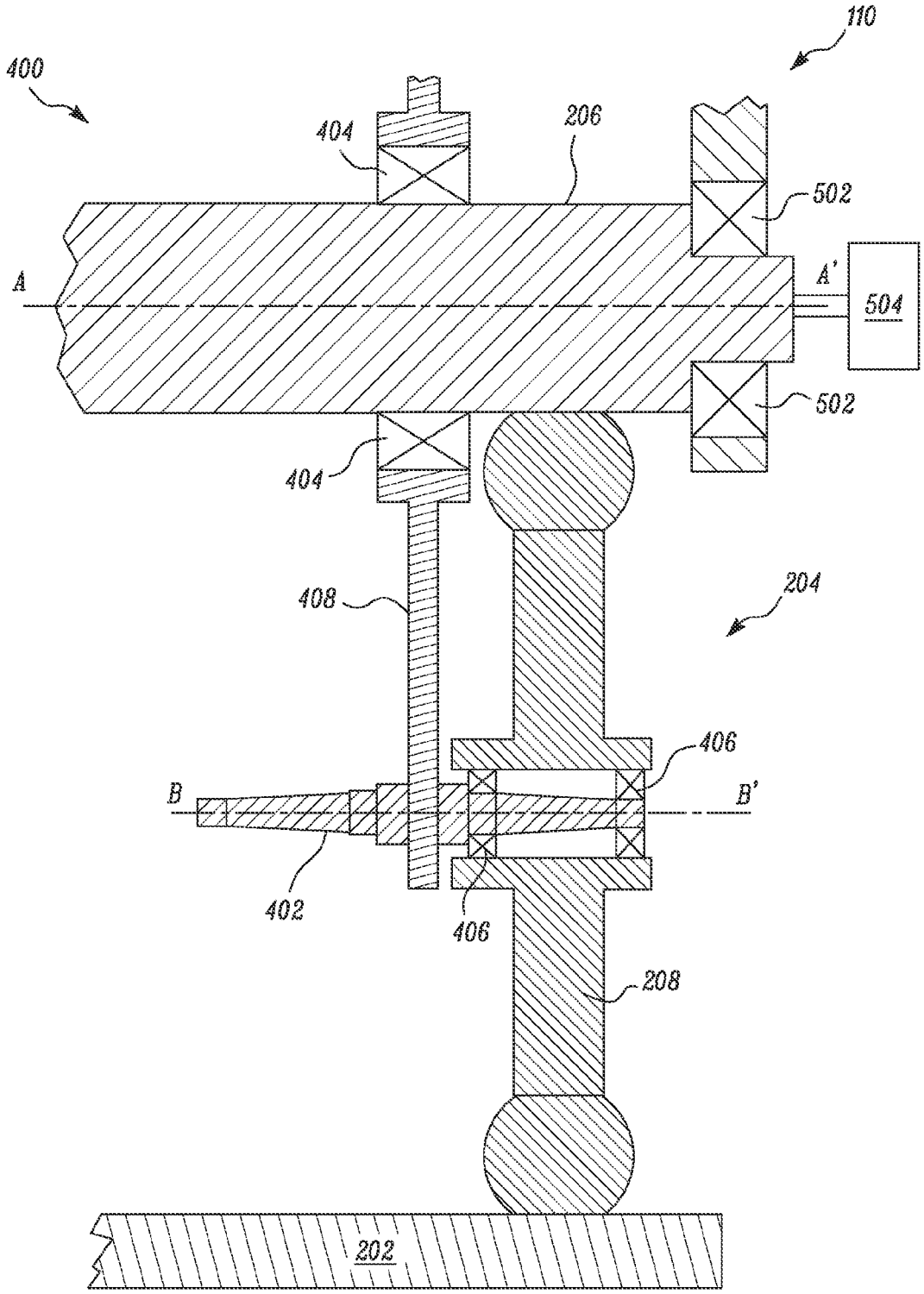

Referring to FIG. 5, an exemplary second drive configuration 500 of the rotary assembly 204 is illustrated. In the second drive configuration 500, the sun element 206 is rotatably coupled to the frame 102 of the machine 100 through a sun bearing 502. Additionally, the sun element 206 is coupled to a drive source 504, such as, a motor. Accordingly, the sun element 206 is the driven member. The motor may be any electric or a hydraulic motor known in the art.

Further, the planet element 208 is frictionally engaged with the sun element 206 and the belt 202. Also, the planet carrier 408 is provided between the sun element 206 and the planet element 208. More specifically, the planet carrier 408 is rotatably coupled to the sun element 206 through the carrier bearing 404. Further, the planet carrier 408 is fixedly coupled to the planet axle 402 of the planet element 208. In such a configuration, the sun element 206 is driven by the drive source 504. Based on the rotation of the sun element 206, the planet element 208 revolves about the sun element 206 due to the frictional engagement therebetween. Accordingly, the planet carrier 408 also rotates about the sun element 206. Also, the planet element 208 rotates about the planet axle 402.

The revolution and/or rotation of the planet element 208 results in multiple passes of compaction on the ground surface through the belt 202 per revolution of the belt 202 on the ground surface. In this configuration, it may be possible to maintain the belt 202 stationary and the rotary assembly 204 operational. Accordingly, multiple passes of compaction may be provided by the planet elements 208 through the belt 202 on same portion of the ground surface. The machine 100 is propelled on the ground surface by the ground engaging members 106. Accordingly, the belt 202 rotates relative to the frame 102 due to the frictional engagement between the belt 202 and the ground surface.

Figure 6:
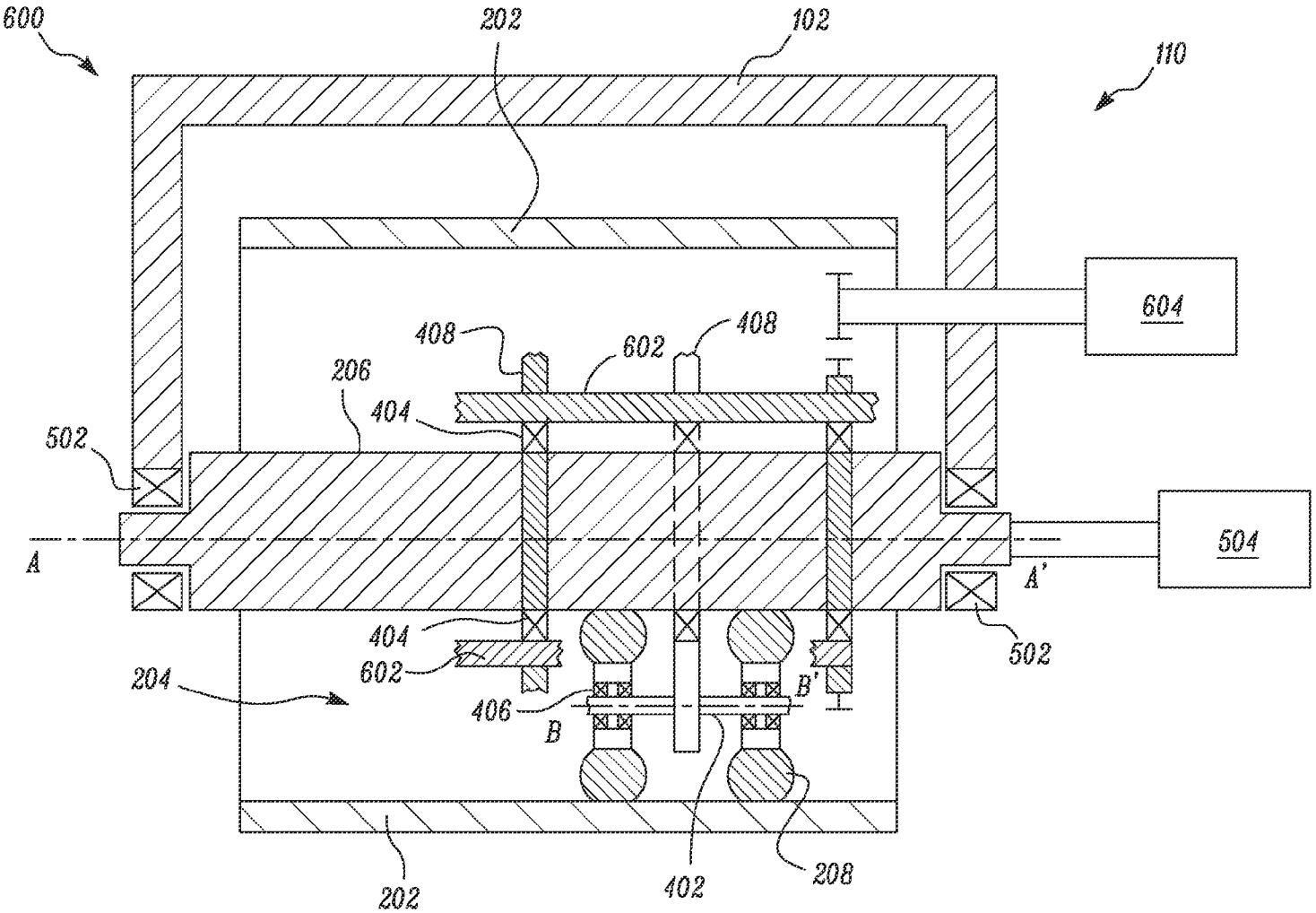

Referring to FIG. 6, an exemplary third drive configuration 600 of the rotary assembly 204 is illustrated. In the third drive configuration 600, the sun element 206 is rotatably coupled to the frame 102 of the machine 100 through the sun bearing 502. Additionally, the sun element 206 is coupled to the drive source 504. Accordingly, the sun element 206 is the driven member in such a configuration. Further, the planet element 208 is frictionally coupled to the sun element 206 and the belt 202.

Also, the planet carrier 408 is coupled to the sun element 206 and the planet element 208. More specifically, the planet carrier 408 is rotatably coupled to the sun element 206 through the carrier bearing 404. Further, the planet carrier 408 is fixedly coupled to the planet axle 402 of the planet element 208. Additionally or optionally, the planet carrier 408 is coupled to a second drive source 604, such as, a motor. The motor may be any electric or a hydraulic motor known in the art. Accordingly, the planet carrier 408 is also the driven member in this configuration. The planet carrier 408 may be coupled to the second drive source 604 through a chain drive, a gear drive and/or a belt drive.

In such a configuration, based on the rotation of the sun element 206 and the planet carrier 408 by the drive source 504 and the second drive source 604 respectively, the planet element 208 revolves about the sun element 206. The planet element 208 revolves about the sun element 206 due to the frictional engagement therebetween. Also, the planet element 208 rotates about the planet axle 402. The rotation and revolution of the planet element 208 is based on the diameter ratios between the sun element 206, the planet element 208, the belt 202, the linear speed of the machine 100, and so on, or a combination thereof. In such a drive configuration, the drive source 504 and the second drive source 604 may provide propulsion to the machine 100 through the belt 202 based on the input speeds of the drive source 504, the second drive source 604 and/or the diameter ratios between the sun element 206, the planet element 208 and/or the belt 202.

Additionally, the belt 202 rotates relative to the frame 102 due to the frictional engagement between the belt 202 and the planet element 208. The revolution and rotation of the planet element 208 results in multiple passes of compaction on the ground surface through the belt 202 per revolution of the belt 202 on the ground surface. Further, the machine 100 is propelled on the ground surface by the belt 202 due to the frictional engagement therebetween. Optionally, the machine 100 may also be propelled on the ground surface by the ground engaging members 106.

In another embodiment (not shown) of the third drive configuration 600, the planet element 208 may be provided in the frictional engagement with only the belt 202. As such, a clearance may be provided between the planet element 208 and the sun element 206 in order to prevent contact and the frictional engagement therebetween. In one embodiment, the sun element 206 may be fixedly coupled to the frame 102. In another embodiment, the sun element 206 may be rotatably coupled to the frame 102 through the sun bearing 502. The drive source 504 for the sun element 206 may also be omitted. Further, the planet carrier 408 may be driven by the second drive source 604.

In such a configuration, based on the rotation of the planet carrier 408 by the second drive source 604, the planet element 208 revolves about the sun element 206. Also, the planet element 208 rotates about the planet axle 402. Additionally, the belt 202 rotates relative to the frame 102 due to the frictional engagement between the belt 202 and the planet element 208. The revolution and rotation of the planet element 208 results in multiple passes of compaction on the ground surface through the belt 202 per revolution of the belt 202 on the ground surface. In this configuration, it may be possible to maintain the belt 202 stationary and the rotary assembly 204 operational. Accordingly, multiple passes of compaction may be provided by the planet element 208 through the belt 202 on the same portion of the ground surface. The machine 100 may be propelled on the ground surface by the ground engaging members 106.

INDUSTRIAL APPLICABILITY

The present disclosure provides the compaction system having the rotary assembly. The compaction system may provide multiple passes of compaction on the ground surface per revolution of the belt thereon. In some situations, the compaction system may provide multiple passes of compaction on the same portion of the ground surface while maintaining the belt stationary. In some situations, the belt may be omitted such that the rotary assembly may directly contact the ground surface and provide multiple passes of compaction thereon. Further, the compaction system may prevent or reduce transverse scuffing and/or tearing of the ground surface during steering or maneuvering of the machine.

In the first drive configuration 400, during rotation of the belt 202 with respect to the frame 102 of the machine 100, the plurality of planet elements 208 may revolve about the sun element 206 and the belt 202. Also, the plurality of planet elements 208 may rotate about the planet axle 402. Accordingly, the plurality of planet elements 208 may provide multiple passes of compaction on the ground surface per revolution of the belt 202 on the ground surface.

In the second drive configuration 500, the sun element 206 may be driven by the drive source 504. Further, the plurality of planet elements 208 may revolve about the sun element 206 and the belt 202. Also, the plurality of planet elements 208 may rotate about the planet axle 402. Accordingly, the plurality of planet elements 208 may provide multiple passes of compaction on the ground surface per revolution of the belt 202 on the ground surface. In this configuration, it may be possible to maintain the belt 202 stationary and provide multiple passes of compaction on the same portion of the ground surface.

In the third drive configuration 600, the sun element 206 and the planet carrier 408 may be driven by the drive source 504 and the second drive source 604 respectively. Further, the plurality of planet elements 208 may revolve about the sun element 206 and the belt 202. Also, the plurality of planet elements 208 may rotate about the planet axle 402. Accordingly, the plurality of planet elements 208 may provide multiple passes of compaction on the ground surface per revolution of the belt 202 on the ground surface. In this configuration, it may be possible to propel the machine 100 on the ground surface by the compaction system 110.

In another embodiment of the third drive configuration 600, the plurality of planet elements 208 may be provided in frictional engagement with the belt 202 only. Also, only the planet carrier 408 may be driven by the second drive source 604. The plurality of planet elements 208 may revolve about the sun element 206 and the belt 202. Also, the plurality of planet elements 208 may rotate about the planet axle 402. Accordingly, the plurality of planet elements 208 may provide multiple passes of compaction on the ground surface per revolution of the belt 202 on the ground surface. In this configuration, it may be possible to maintain the belt 202 stationary and provide multiple passes of compaction on the same portion of the ground surface.

Multiple passes of compaction provided by the rotary assembly 204 may reduced formation of cracks in the ground surface or an asphalt surface, thus, preventing failure and erosion thereof. Further, providing multiple passes of compaction per revolution of the belt 202 or providing multiple passes on the same portion of the ground surface by maintaining the belt 202 stationary may lead to improved productivity of the machine 100 and cost efficiency of the compaction process.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A compaction system for providing one or more compaction passes for each pass of the compaction system, the compaction system comprising:

a belt; and a sun element having a first axis and positioned within the belt; and a planet element engaged with the sun element and the belt, the planet element configured to revolve around the sun element and the first axis, wherein the belt revolves around the sun element, wherein for every revolution of the belt around the sun element, the planet element completes one or more revolutions around the sun element and provides one or more compaction passes through the belt.

2. The compaction system of claim 1, wherein the planet element is further configured to rotate about a second axis parallel to the first axis, wherein the second axis revolves around the first axis.

3. The compaction system of claim 1 further comprising a planet carrier coupled to the sun element and the planet element.

4. The compaction system of claim 1 further comprising a plurality of planet elements defining a plurality of second axes, each of the plurality of planet elements is angularly offset around a circumference of the sun element.

5. The compaction system of claim 4, wherein each of the plurality of planet elements is further transversely offset around the circumference of the sun element.

6. The compaction system of claim 1, wherein the planet element completes multiple revolutions around the sun element for one revolution of the belt.

7. The compaction system of claim 1, wherein the planet element is any one of a pneumatic tire and a metallic roller.

8. The compaction system of claim 1 further comprises a vibratory mechanism.

9. A compaction machine comprising:

a frame;

a power source provided on the frame; and at least one compaction system rotatably coupled to the frame, the at least one compaction system configured for providing one or more compaction passes for each pass of the at least one compaction system, the at least one compaction system comprising:

a belt; and a sun element having a first axis and positioned within the belt; and a planet element engaged with the sun element and the belt, the planet element configured to revolve around the sun element and the first axis, wherein the belt revolves around the sun element, wherein for every revolution of the belt around the sun element, the planet element completes one or more revolutions around the sun element and provides one or more compaction passes through the belt.

10. The compaction machine of claim 9, wherein the planet element is further configured to rotate about a second axis parallel to the first axis, wherein the second axis revolves around the first axis.

11. The compaction machine of claim 9 further comprising a planet carrier coupled to the sun element and the planet element.

12. The compaction machine of claim 9 further comprising a plurality of planet elements defining a plurality of second axes, each of the plurality of planet elements is angularly offset around a circumference of the sun element.

13. The compaction machine of claim 12, wherein each of the plurality of planet elements is further transversely offset around the circumference of the sun element.

14. The compaction machine of claim 9, wherein the planet element completes multiple revolutions around the sun element for one revolution of the belt.

15. The compaction machine of claim 9, wherein the planet element is any one of a pneumatic tire and a metallic roller.

* * * * *